US005913193A

United States Patent [19]

Huang et al.

[11] Patent Number: 5,913,193

[45] Date of Patent: Jun. 15, 1999

[54] METHOD AND SYSTEM OF RUNTIME ACOUSTIC UNIT SELECTION FOR SPEECH SYNTHESIS

[75] Inventors: Xuedong D. Huang, Redmond, Wash.; Michael D. Plumpe, Cambridge, Mass.; Alejandro Acero, Redmond; James L. Adcock, Bellevue, both of Wash.

[73] Assignee: Microsoft Corporation, Redmond, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/648,808

[22] Filed: Apr. 30, 1996

[51] Int. Cl.[6] ..... G10L 5/02; G10L 9/00

[52] U.S. Cl. ..... 704/258; 704/256

[58] Field of Search ..... 704/258, 256, 704/241, 239, 238, 260

[56] References Cited

U.S. PATENT DOCUMENTS

| | | | |
|---|---|---|---|
| 4,748,670 | 5/1988 | Bahl et al. | 704/251 |
| 4,759,068 | 7/1988 | Bahl et al. | 704/251 |
| 4,783,803 | 11/1988 | Baker et al. | 381/42 |
| 4,817,156 | 3/1989 | Bahl et al. | 381/43 |
| 4,829,577 | 5/1989 | Kuroda et al. | 381/45 |
| 4,866,778 | 9/1989 | Baker | 381/43 |
| 5,027,406 | 6/1991 | Roberts et al. | 381/43 |
| 5,241,619 | 8/1993 | Schwartz et al. | 704/200 |
| 5,349,645 | 9/1994 | Zhao | 704/243 |
| 5,621,859 | 4/1997 | Schwartz et al. | 704/256 |

FOREIGN PATENT DOCUMENTS

| | | | |
|---|---|---|---|
| WO 94/17517 | 8/1994 | WIPO | G10L 5/02 |

OTHER PUBLICATIONS

Nakajima et al., "Automatic Generation of Synthesis Units Based on Context Clustering" ICASSP '88: Acoustics, Speech &Signal Processing Conference, pp. 659–662.

Donovan, E., "Automatic Speech Synthesizer Parameter Estimation using HMMS" ICASSP '95:Acoustics, Speech & Signal Processing Conference, pp. 640–643.

Iwahashi, N. et al, "Concatenative Speech Synthesis by Minimum Distortion Criteria", ICASSP '92 :Acoustics, Speech & Signal Processing Conference, pp. II–65–II–68.

Bahl, et al., "A Maximum Likelihood Approach to Continuous Speech Recognition,"*IEEE Transactions on Pattern Analysis and Machine Intelligence*; 1983; pp. 308–319.

Lee, Kai–Fu, "Context–Dependent Phonetic Hidden Markov Models for Speaker–Independent Continuous Speech Recognition," *IEEE Transactions on Acoustics, Speech and Signal Processing*; Apr., 1990; pp. 347–362.

(List continued on next page.)

*Primary Examiner*—David R. Hudspeth
*Assistant Examiner*—Patrick N. Edouard
*Attorney, Agent, or Firm*—Westman, Champlin & Kelly, P.A.

[57] ABSTRACT

The present invention pertains to a concatenative speech synthesis system and method which produces a more natural sounding speech. The system provides for multiple instances of each acoustic unit which can be used to generate a speech waveform representing an linguistic expression. The multiple instances are formed during an analysis or training phase of the synthesis process and are limited to a robust representation of the highest probability instances. The provision of multiple instances enables the synthesizer to select the instance which closely resembles the desired instance thereby eliminating the need to alter the stored instance to match the desired instance. This in essence minimizes the spectral distortion between the boundaries of adjacent instances thereby producing more natural sounding speech.

19 Claims, 9 Drawing Sheets

OTHER PUBLICATIONS

Huang, Xuedong et al., "An Overview of the SPHINX–II Speech Recognition System," *Proceedings of ARPA Human Language Technology Workshop*; 1993; pp. 1–6.

Huang, X.D., and M. A. Jack, "Semi–continuous hidden Markov models for speech signals," *Computer Speech and Language*, vol. 3, 1989; pp. 239–251.

Baker, James K., "Stochastic Modeling for Automatic Speech Understanding," *Speech Recognition*, Editor P.R. Reddy; pp. 297–307.

"1993 IEEE International Conference on Acoustics, Speech, and Signal Processing." *ICASSP—93—Speech Processing Volume II of V*, Minneapolis Convention Center; Apr. 27–30, 1993; pp. 311–314.

Gelsema et al. (Ed.), "Pattern Recognition in Practice," *Proceedings of an International Workshop held in Amsterdam*; May 21–23, 1980; pp. 381–402.

Rabiner, Lawerence, and Bing–Hwang Juang, "Fundamentals of Speech Recognition," Prentice Hall Publishers; 1993; Chapter 6; pp. 372–373.

Lee, Kai–Fu et al., "Automatic Speech Recognition—The Development of the SPHINX System," Kluwer Academic Publishers; 1989; pp. 51–62, and 118–126.

Huang, X.D. et al, "Hidden Markov Models for Speech Recognition," Edinburgh University Press; 1990; pp. 210–212.

"Developing NeXTSTEP™ Applications," SAMS Publishing; 1995; pp. 118–144.

Itoh et al., "Sub–Phonemic Optimal Path Search for Concatenative Speech Synthesis," Esca. Eurospeech '95 4th European Conference on Speech Communication and Technology, Madrid; Sep., 1995; pp. 577–580.

Rabiner et al., "High Performance Connected Digit Recognition Using Hidden Markov Models," Proceedings of ICASSP–88, 1988; pp. 320–330.

Moulines, Eric, and Francis Charpentier, "Pitch–Synchronous Waveform Processing Techniques for Text–To–Speech Synthesis Using Diphones," *Speech Communications 9*; 1990; pp. 453–467.

Breckenridge Pierrehumbert, Janet, "Phol0logy and Phonetics of English Intonation," Massachusetts Institute of Technology, Sep. 1980, pp. 1–401.

"Development of a Text–To–Speech System for Japanese Based on Waveform Splicing", by Hisashi Sawai et al., 1994 *IEEE*, pp. I–569–I–572.

"Speech Segment Selection for Concatenative Synthesis Based on Spectral Distortion Minimization", by Naoti Iwahashi et al., *IEICE Transactions on Fundamentals of Electronics, Communications and Computer Sciences*, 76 (a) 1993, Nov., No. 11, Tokyo, JP, pp. 1942–1948.

METHOD AND SYSTEM OF RUNTIME ACOUSTIC UNIT SELECTION FOR SPEECH SYNTHESIS

TECHNICAL FIELD

This invention relates generally to a speech synthesis system, and more specifically, to a method and system for performing acoustic unit selection in a speech synthesis system.

BACKGROUND OF THE INVENTION

Concatenative speech synthesis is a form of speech synthesis which relies on the concatenation of acoustic units that correspond to speech waveforms to generate speech from written text. An unsolved problem in this area is the optimal selection and concatenation of the acoustic units in order to achieve fluent, intelligible, and natural sounding speech.

In many conventional speech synthesis systems, the acoustic unit is a phonetic unit of speech, such as a diphone, phoneme, or phrase. A template or instance of a speech waveform is associated with each acoustic unit to represent the phonetic unit of speech. The mere concatenation of a string of instances to synthesize speech often results in unnatural or "robotic-sounding" speech due to spectral discontinuities present at the boundary of adjacent instances. For the best natural sounding speech, the concatenated instances must be generated with timing, intensity, and intonation characteristics (i.e., prosody) that are appropriate for the intended text.

Two common techniques are used in conventional systems to generate natural sounding speech from the concatenation of instances of acoustical units: the use of smoothing techniques and the use of longer acoustical units. Smoothing attempts to eliminate the spectral mismatch between adjacent instances by adjusting the instances to match at the boundaries between the instances. The adjusted instances create a smoother sounding speech but the speech is typically unnatural due to the manipulations that were made to the instances to realize the smoothing.

Choosing a longer acoustical unit usually entails employing diphones, since they capture the coarticulary effects between phonemes. The coarticulary effects are the effects on a given phoneme due to the phoneme that precedes and the phoneme that follows the given phoneme. The use of longer units having three or more phonemes per unit helps to reduce the number of boundaries which occur and capture the coarticulary effects over a longer unit. The use of longer units results in a higher quality sounding speech but at the expense of requiring a significant amount of memory. In addition, the use of the longer units with unrestricted input text can be problematic because coverage in the models may not be guaranteed.

SUMMARY OF THE INVENTION

The preferred embodiment of the present invention pertains to a speech synthesis system and method which generates natural sounding speech. Multiple instances of acoustical units, such as diphones, triphones, etc., are generated from training data of previously spoken speech. The instances correspond to a spectral representation of a speech signal or waveform which is used to generate the associated sound. The instances generated from the training data are then pruned to form a robust subset of instances.

The synthesis system concatenates one instance of each acoustical unit present in an input linguistic expression. The selection of an instance is based on the spectral distortion between boundaries of adjacent instances. This can be performed by enumerating possible sequences of instances which represent the input linguistic expression from which one is selected that minimizes the spectral distortion between all boundaries of adjacent instances in the sequence. The best sequence of instances is then used to generate a speech waveform which produces spoken speech corresponding to the input linguistic expression.

BRIEF DESCRIPTION OF THE DRAWINGS

The foregoing features and advantages of the invention will be apparent from the following more particular description of the preferred embodiment of the invention, as illustrated in the accompanying drawings in which like reference characters refer to the same elements throughout the different views. The drawings are not necessarily to scale, emphasis instead being placed upon illustrating the principles of the invention.

DETAILED DESCRIPTION OF THE INVENTION

The preferred embodiment produces natural sounding speech by choosing one instance of each acoustic unit required to synthesize the input text from a selection of multiple instances and concatenating the chosen instances. The speech synthesis system generates multiple instances of an acoustic unit during the analysis or training phase of the system. During this phase, multiple instances of each acoustic unit are formed from speech utterances which reflect the most likely speech patterns to occur in a particular language. The instances which are accumulated during this phase are then pruned to form a robust subset which contains the most representative instances. In the preferred embodiment, the highest probability instances representing diverse phonetic contexts are chosen.

During the synthesis of speech, the synthesizer can select the best instance for each acoustic unit in a linguistic expression at runtime and as a function of the spectral and prosodic distortion present between the boundaries of adjacent instances over all possible combinations of the instances. The selection of the units in this manner eliminates the need to smooth the units in order to match the frequency spectra present at the boundaries between adjacent units. This generates a more natural sounding speech since the original waveform is utilized rather than an unnaturally modified unit.

Figure 1:
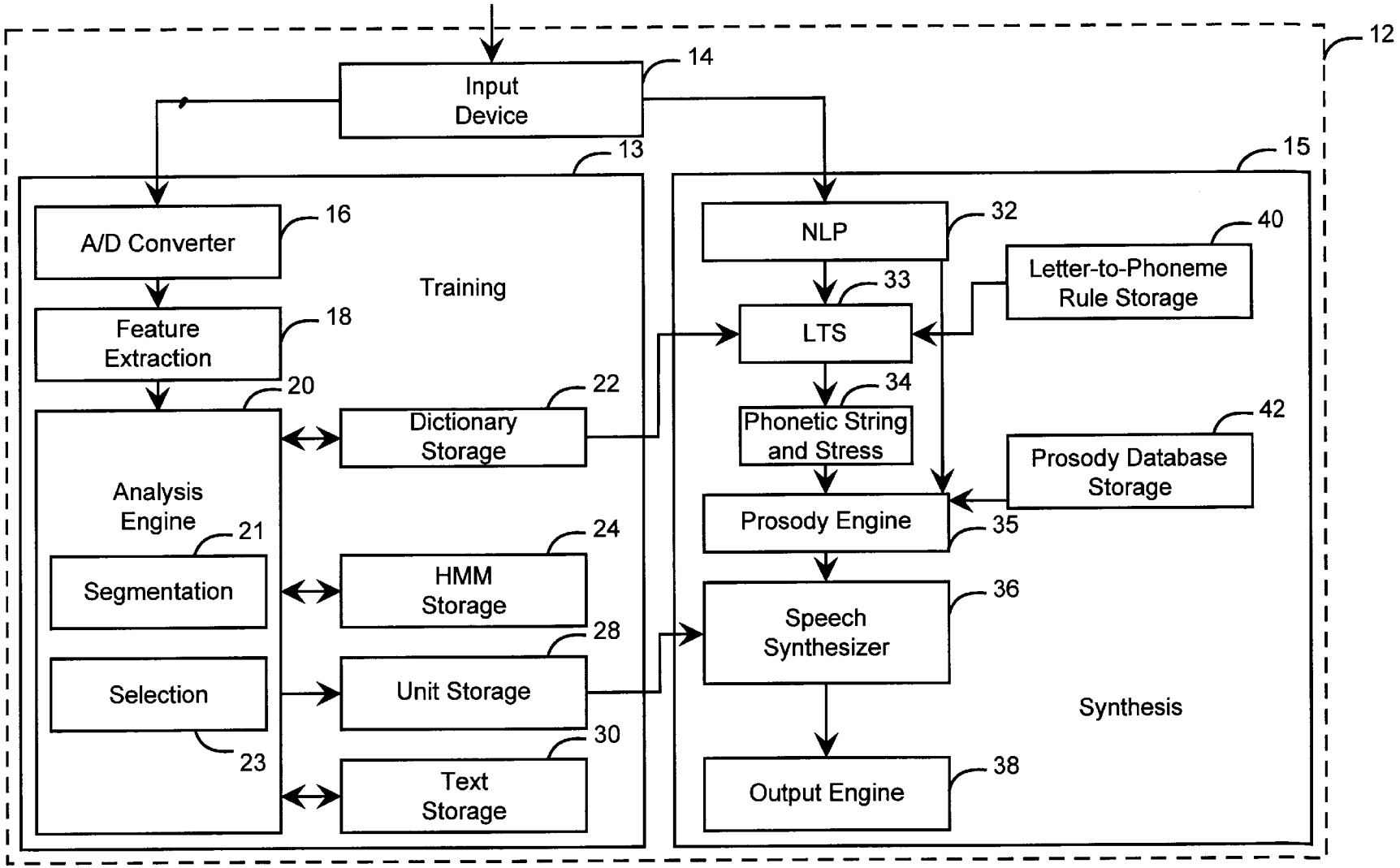
FIG. 1 is a speech synthesis system for use in performing the speech synthesis method of the preferred embodiment.

FIG. 1 depicts a speech synthesis system 10 that is suitable for practicing the preferred embodiment of the present invention. The speech synthesis system 10 contains input device 14 for receiving input. The input device 14 may be, for example, a microphone, a computer terminal or the like. Voice data input and text data input are processed by separate processing elements as will be explained in more detail below. When the input device 14 receives voice data, the input device routes the voice input to the training components 13 which perform speech analysis on the voice input. The input device 14 generates a corresponding analog signal from the input voice data, which may be an input speech utterance from a user or a stored pattern of utterances. The analog signal is transmitted to analog-to-digital converter 16, which converts the analog signal to a sequence of digital samples. The digital samples are then transmitted to a feature extractor 18 which extracts a parametric representation of the digitized input speech signal. Preferably, the feature extractor 18 performs spectral analysis of the digitized input speech signal to generate a sequence of frames, each of which contains coefficients representing the frequency components of the input speech signal. Methods for performing the spectral analysis are well-known in the art of signal processing and can include fast Fourier transforms, linear predictive coding (LPC), and cepstral coefficients. Feature extractor 18 may be any conventional processor that performs spectral analysis. In the preferred embodiment, spectral analysis is performed every ten milliseconds to divide the input speech signal into a frame which represents a portion of the utterance. However, this invention is not limited to employing spectral analysis or to a ten millisecond sampling time frame. Other signal processing techniques and other sampling time frames can be used. The above-described process is repeated for the entire speech signal and produces a sequence of frames which is transmitted to analysis engine 20. Analysis engine 20 performs several tasks which will be detailed below with reference to FIGS. 2–4.

The analysis engine 20 analyzes the input speech utterances or training data in order to generate senones (a senone is a cluster of similar markov states across different phonetic models) and parameters of the hidden Markov models which will be used by a speech synthesizer 36. Further, the analysis engine 20 generates multiple instances of each acoustic unit which is present in the training data and forms a subset of these instances for use by the synthesizer 36. The analysis engine includes a segmentation component 21 for performing segmentation and a selection component 23 for selecting instances of acoustic units. The role of these components will be described in more detail below. The analysis engine 20 utilizes the phonetic representation of the input speech utterance, which is obtained from text storage 30, a dictionary containing a phonemic description of each word, which is stored in dictionary storage 22, and a table of senones stored in HMM storage 24.

The segmentation component 21 has a dual objective: to obtain the HMM parameters for storage in HMM storage and to segment input utterances into senones. This dual objective is achieved by an iterative algorithm that alternates between segmenting the input speech given a set of HMM parameters and re-estimating the HMM parameters given the speech segmentation. The algorithm increases the probability of the HMM parameters generating the input utterances at each iteration. The algorithm is stopped when convergence is reached and further iterations do not increase substantially the training probability.

Once segmentation of the input utterances is completed, the selection component 23 selects a small subset of highly representative occurrences of each acoustic unit (i.e., diphone) from all possible occurrences of each acoustic unit and stores the subsets in unit storage 28. This pruning of occurrences relies on values of HMM probabilities and prosody parameters, as will be described in more detail below.

Figure 5:
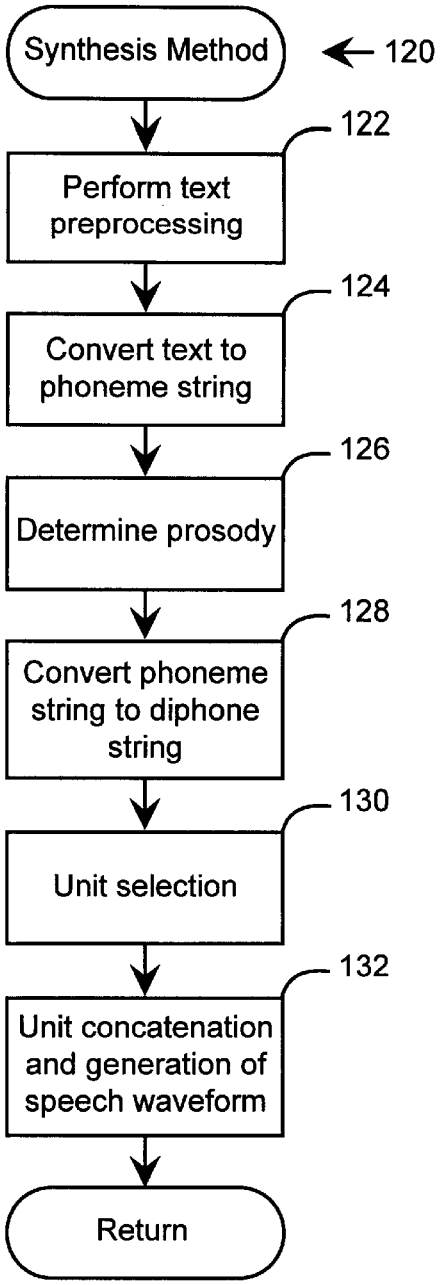
FIG. 5 is a flow diagram of the synthesis method of the preferred embodiment.
Figure 6A:
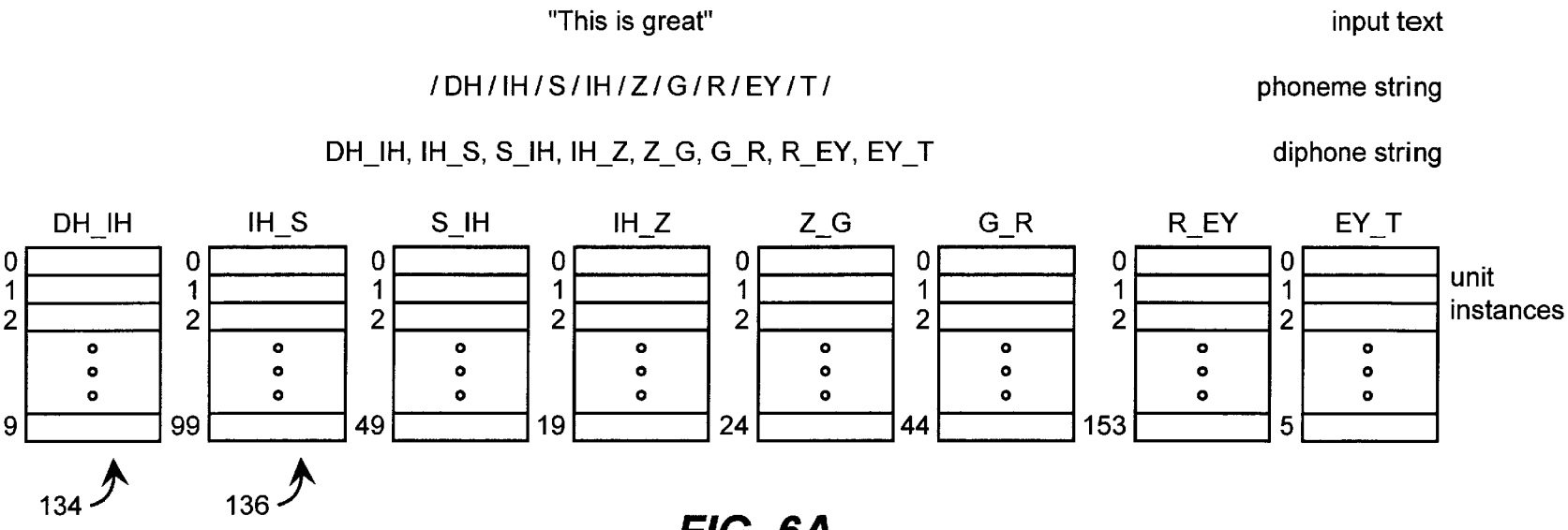
FIG. 6A depicts an example of how speech is synthesized for the text "This is great" in accordance with the speech synthesis method of the preferred embodiment of the present invention.
Figure 6B:
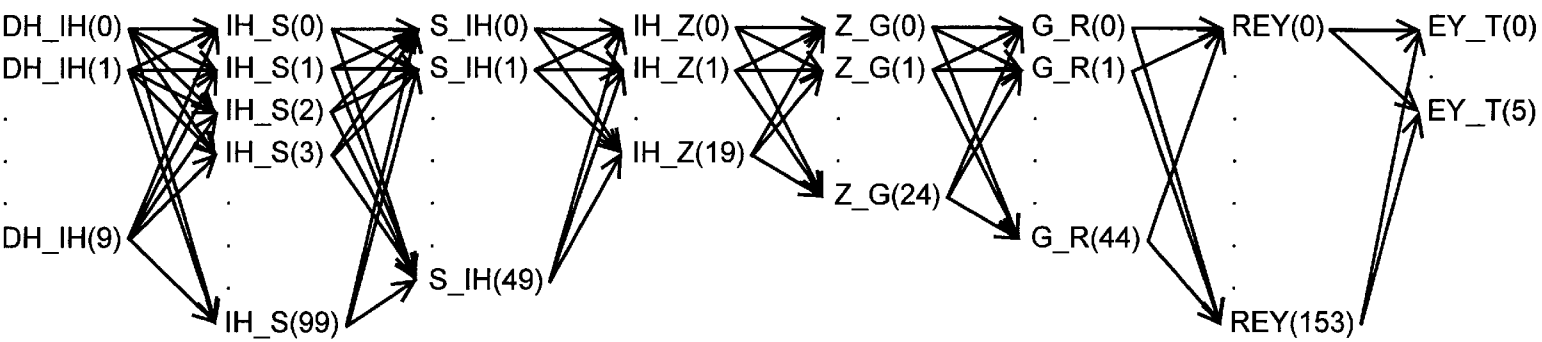
FIG. 6B is an example that illustrates the unit selection method for the text "This is great."
Figure 6C:
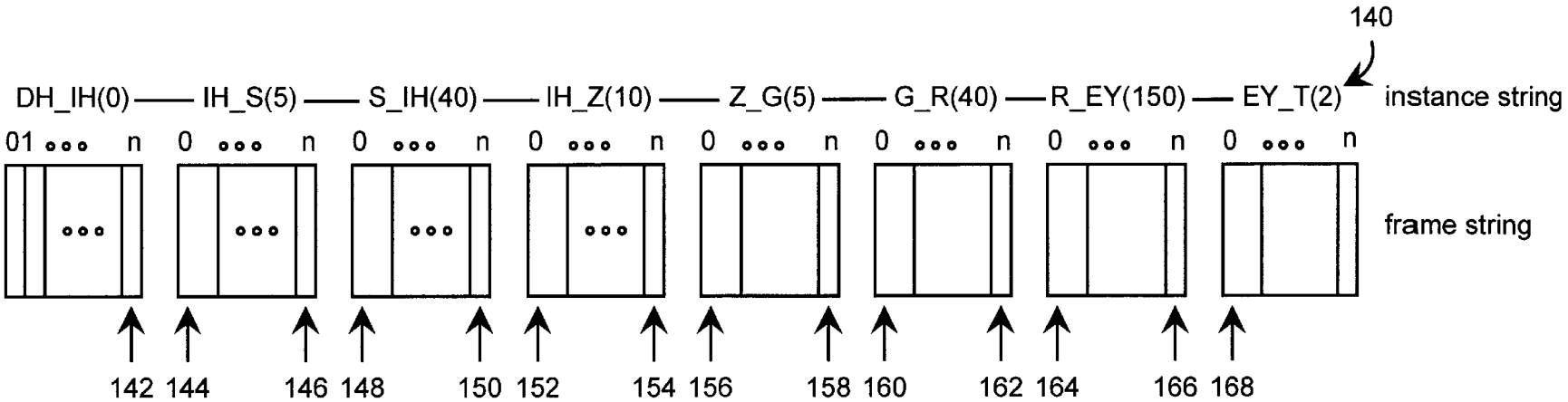
FIG. 6C is an example that further illustrates the unit selection method for one instance string corresponding to the text "This is great."
Figure 7:
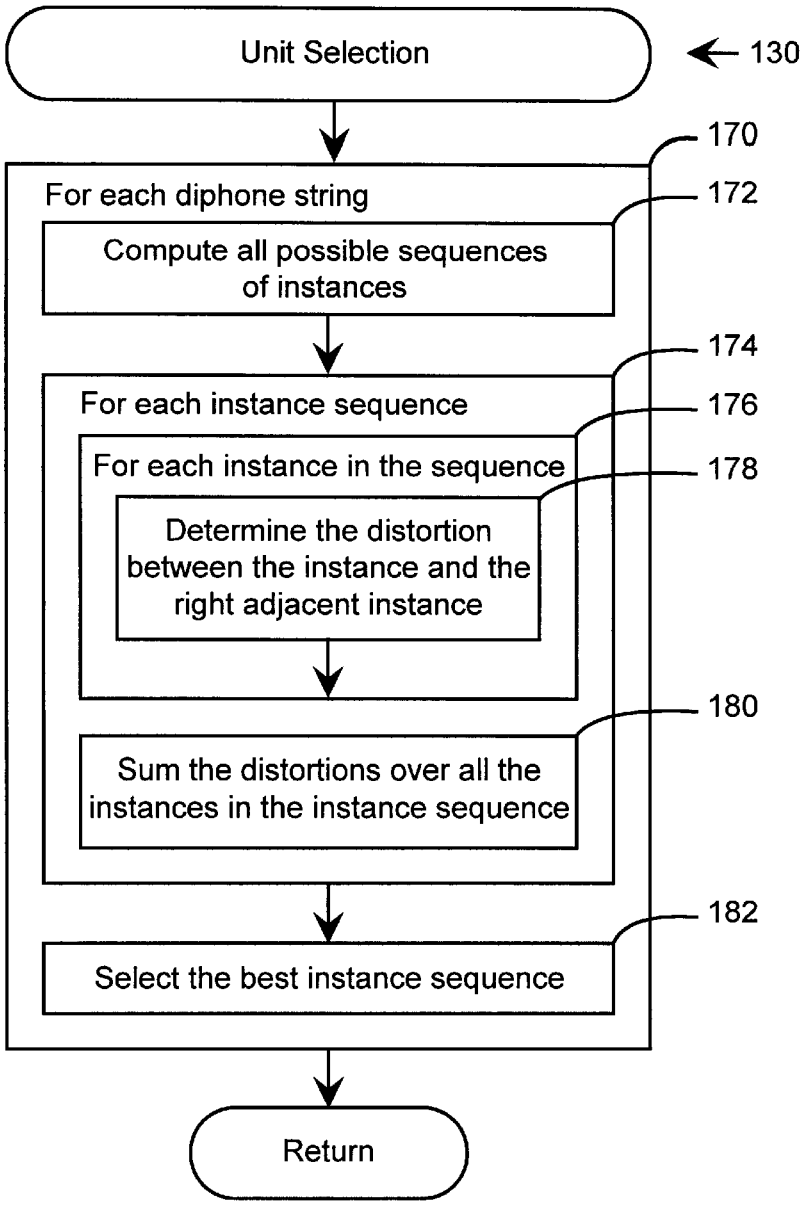
FIG. 7 is a flow diagram of the unit selection method of the present embodiment.

When input device 14 receives text data, the input device 14 routes the text data input to the synthesis components 15 which perform speech synthesis. FIGS. 5–7 illustrate the speech synthesis technique employed in the preferred embodiment of the present invention and will be described in more detail below. The natural language processor (NLP) 32 receives the input text and tags each word of the text with a descriptive label. The tags are passed to a letter-to-sound (LTS) component 33 and a prosody engine 35. The letter-to-sound component 33 utilizes dictionary input from the dictionary storage 22 and letter-to-phoneme rules from the letter-to-phoneme rule storage 40 to convert the letters in the input text to phonemes. The letter-to-sound component 33 may, for example, determine the proper pronunciation of the input text. The letter-to-sound component 33 is connected to a phonetic string and stress component 34. The phonetic string and stress component 33 generates a phonetic string with proper stressing for the input text, that is passed to a prosody engine 35. The letter-to-sound component 33 and phonetic stress component 33 may, in alternative embodiments, be encapsulated into a single component. The prosody engine 35 receives the phonetic string and inserts pause markers and determines the prosodic parameters which indicate the intensity, pitch, and duration of each phoneme in the string. The prosody engine 35 uses prosody models, stored in prosody database storage 42. The phoneme string with pause markers and the prosodic parameters indicating pitch, duration, and amplitude is transmitted to speech synthesizer 36. The prosody models may be speaker-independent or speaker-dependent.

The speech synthesizer 36 converts the phonetic string into the corresponding string of diphones or other acoustical units, selects the best instance for each unit, adjusts the instances in accordance with the prosodic parameters and generates a speech waveform reflecting the input text. For illustrative purposes in the discussion below, it will be assumed that the speech synthesizer converts the phonetic string into a string of diphones. Nevertheless, the speech synthesizer could alternatively convert the phonetic string into a string of alternative acoustical units. In performing these tasks, the synthesizer utilizes the instances for each unit which are stored in unit storage 28.

The resulting waveform can be transmitted to output engine 38 which can include audio devices for generating the speech or, alternatively, transfer the speech waveform to other processing elements or programs for further processing.

The above-mentioned components of the speech synthesis system 10 can be incorporated into a single processing unit such as a personal computer, workstation or the like. However, the invention is not limited to this particular computer architecture. Other structures may be employed, such as but not limited to, parallel processing systems, distributed processing systems, or the like.

Prior to discussing the analysis method, the following section will present the senone, HMM, and frame structures used in the preferred embodiment. Each frame corresponds to a certain segment of the input speech signal and can represent the frequency and energy spectra of the segment. In the preferred embodiment, LPC cepstral analysis is employed to model the speech signal and results in a sequence of frames, each frame containing the following 39 cepstral and energy coefficients that represent the frequency and energy spectra for the portion of the signal in the frame: (1) 12 mel-frequency cepstral coefficients; (2) 12 delta mel-frequency cepstral coefficients; (3) 12 delta delta mel-frequency cepstral coefficients; and (4) an energy, delta energy, and delta-delta energy coefficients.

A hidden Markov model (HMM) is a probabilistic model which is used to represent a phonetic unit of speech. In the preferred embodiment, it is used to represent a phoneme. However, this invention is not limited to this phonetic basis, any linguistic expression can be used, such as but not limited to, a diphone, word, syllable, or sentence.

A HMM consists of a sequence of states connected by transitions. Associated with each state is an output probability indicating the likelihood that the state matches a frame. For each transition, there is an associated transition probability indicating the likelihood of following the transition. In the preferred embodiment, a phoneme can be modeled by a three state HMM. However, this invention is not limited to this type of HMM structure, others can be employed which can utilize more or less states. The output probability associated with a state can be a mixture of Gaussian probability density functions (pdfs) of the cepstral coefficients contained in a frame. Gaussian pdfs are preferred, however, the invention is not limited to this type of pdfs. Other pdfs can be used, such as, but not limited to, Laplacian-type pdfs.

The parameters of a HMM are the transition and output probabilities. Estimates for these parameters are obtained through statistical techniques utilizing the training data. Several well-known algorithms exist which can be utilized to estimate these parameters from the training data.

Two types of HMMs can be employed in the claimed invention. The first are context-dependent HMMs which model a phoneme with its left and right phonemic contexts. Predetermined patterns consisting of a set of phonemes and their associated left and right phonemic context are selected to be modeled by the context-dependent HMM. These patterns are chosen since they represent the most frequently occurring phonemes and the most frequently occurring contexts of these phonemes. The training data will provide estimates for the parameters of these models. Context-independent HMMs can also be used to model a phoneme independently of its left and right phonemic contexts. Similarly, the training data will provide the estimates for the parameters of the context-independent models. Hidden Markov models are a well-known techniques and a more detailed description of HMMs can be found in Huang, et al., *Hidden Markov Models For Speech Recognition,* Edinburgh University Press, 1990, which is hereby incorporated by reference.

The output probability distributions of the states of the HMMs are clustered to form senones. This is done in order to reduce the number of states which impose large storage requirements and an increased computational time for the synthesizer. A more detailed description of senones and the method used to construct them can be found in M. Hwang, et al., *Predicting Unseen Triphones with Senones*, Proc. ICASSP '93 Vol. II, pp. 311–314, 1993 which is hereby incorporated by reference.

Figure 2:
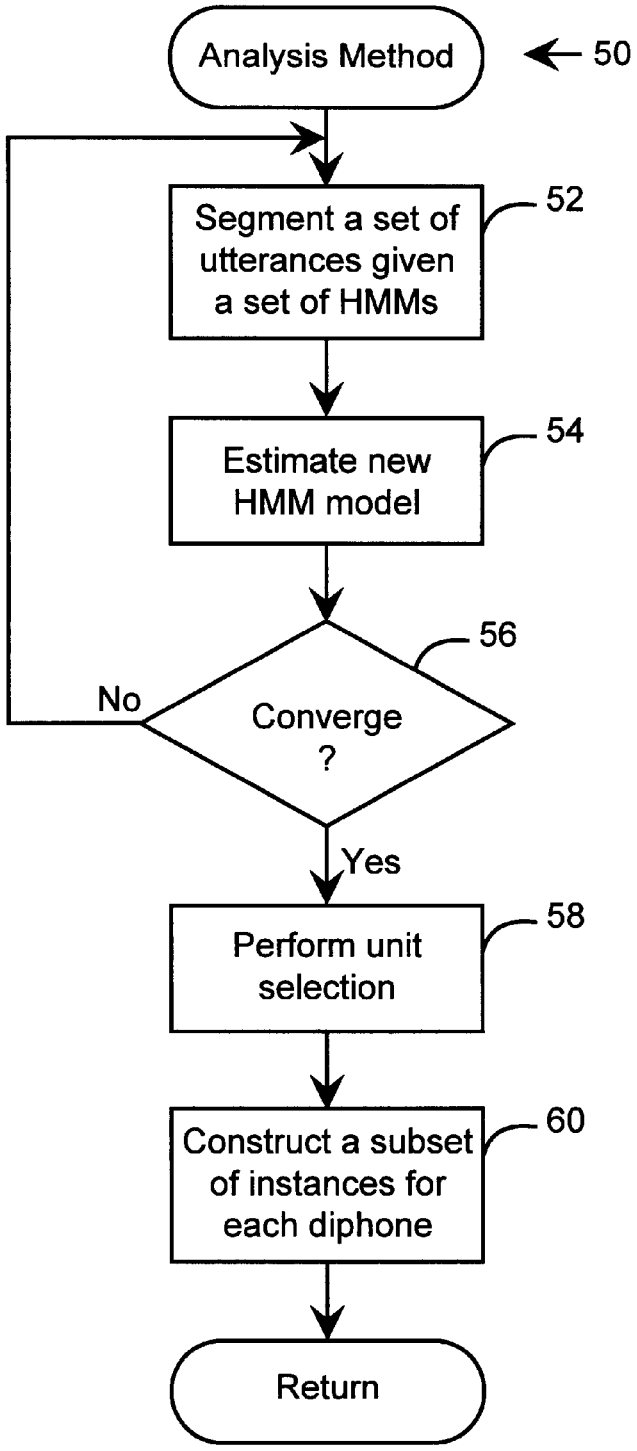
FIG. 2 is a flow diagram of an analysis method employed in the preferred embodiment.
Figure 3A:
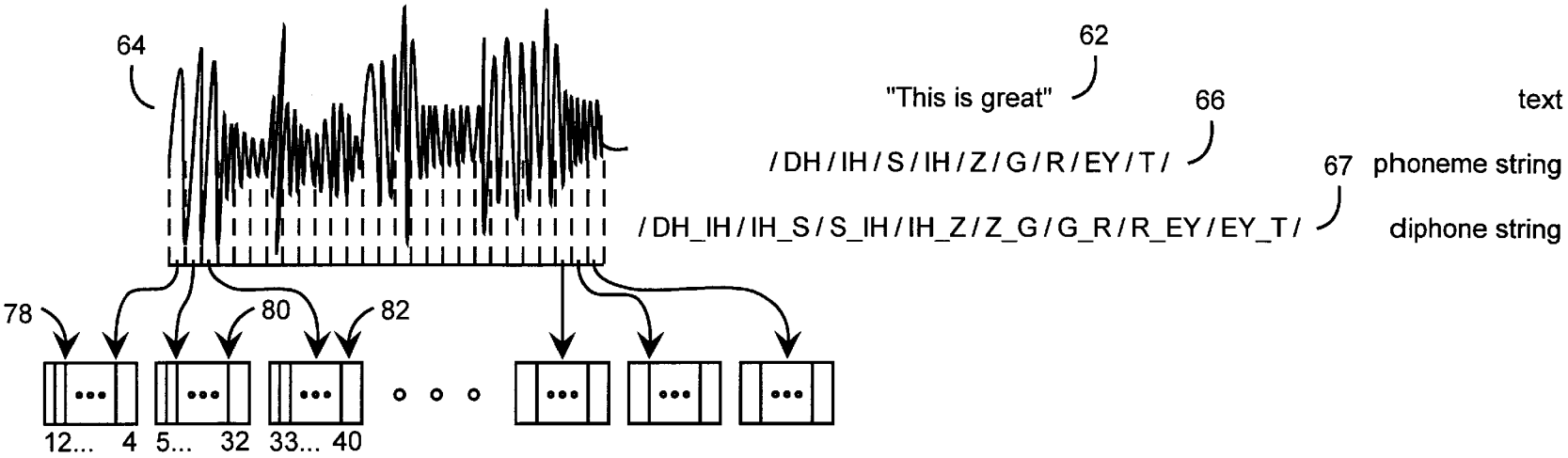
FIG. 3A is an example of the alignment of a speech waveform into frames which corresponds to the text "This is great."
Figure 3B:
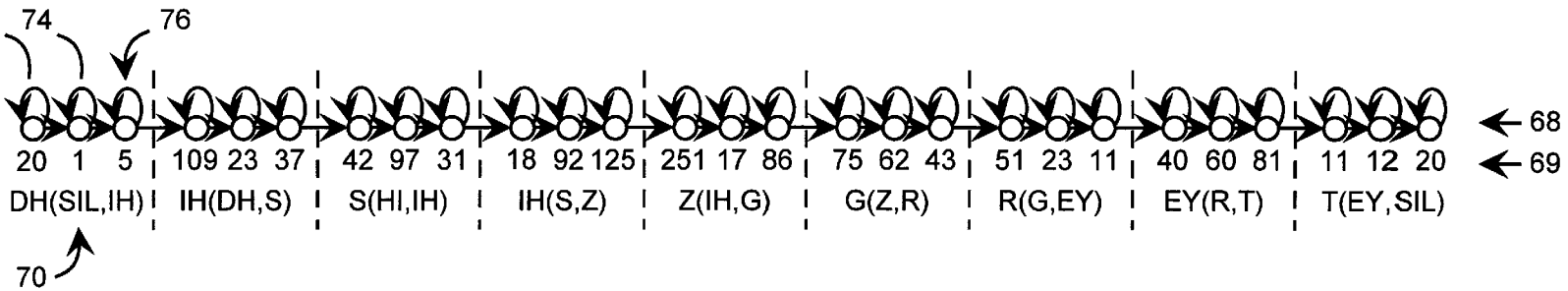
FIG. 3B illustrates the HMM and senone strings which correspond to the speech waveform of the example in FIG. 3A.
Figure 3D:
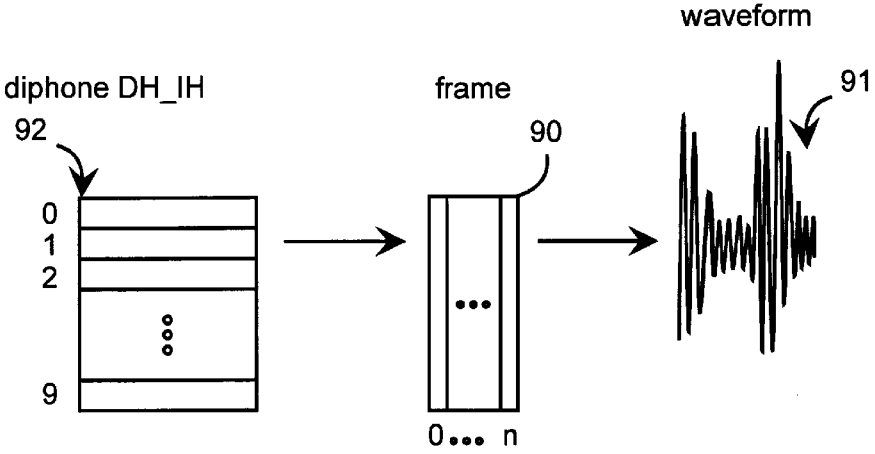
FIG. 3D is an example which further illustrates the instance of the diphone DH_IH.
Figure 3C:
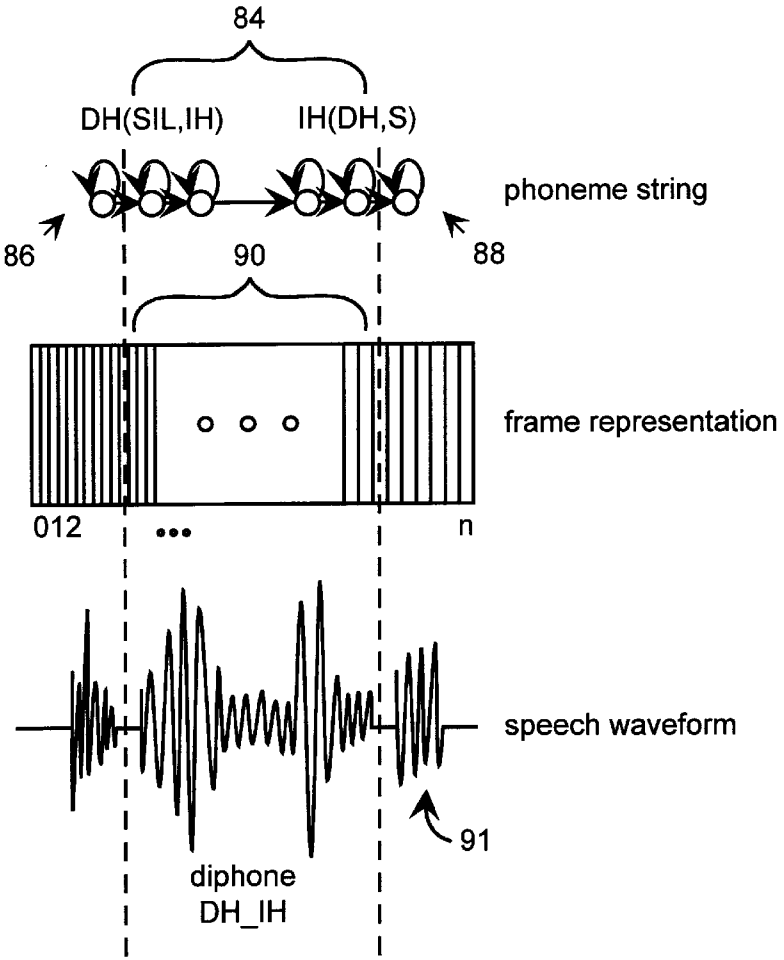
FIG. 3C is an example of the instance of the diphone DH_IH.
Figure 4:
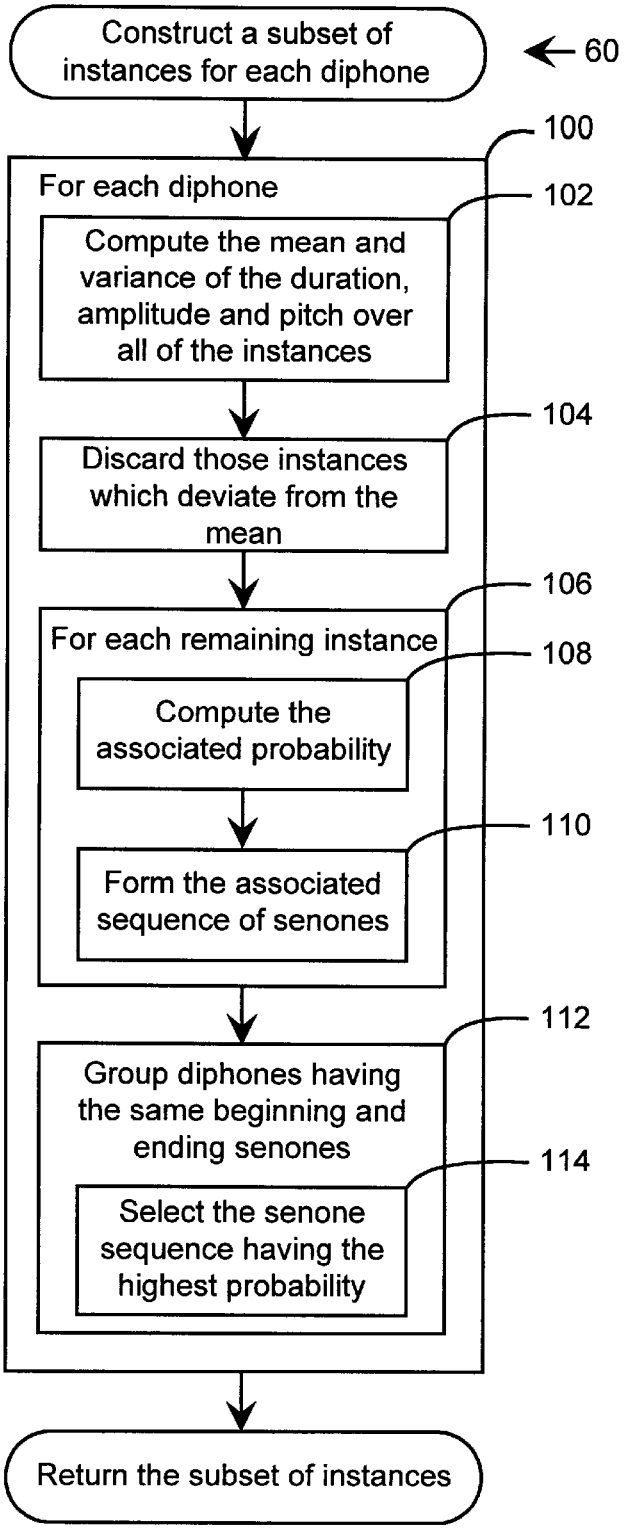
FIG. 4 is a flow diagram of the steps used to construct a subset of instances for each diphone.

FIGS. 2–4 illustrate the analysis method performed by the preferred embodiment of the present invention. Referring to FIG. 2, the analysis method 50 can commence by receiving training data in the form of a sequence of speech waveforms (otherwise referred to as speech signals or utterances), which are converted into frames as was previously described above with reference to FIG. 1. The speech waveforms can consist of sentences, words, or any type of linguistic expression and are herein referred to as the training data.

As was described above, the analysis method employs an iterative algorithm. Initially, it is assumed that an initial set of parameters for the HMMs have been estimated. FIG. 3A illustrates the manner in which the parameters for the HMMs are estimated for an input speech signal corresponding to the linguistic expression "This is great." Referring to FIGS. 3A and 3B, the text 62 corresponding to the input speech signal or waveform 64 is obtained from text storage 30. The text 62 can be converted to a string of phonemes 66 which is obtained for each word in the text from the dictionary stored in dictionary storage 22. The phoneme string 66 can be used to generate a sequence of context-dependent HMMs 68 which correspond to the phonemes in the phoneme string. For example, the phoneme /DH/ in the context shown has an associated context-dependent HMM, denoted as DH(SIL, IH) 70, where the left phoneme is /SIL/ or silence and the right phoneme is /IH/. This context-dependent HMM has three states and associated with each state is a senone. In this particular example, the senones are 20, 1, and 5 which correspond to states 1, 2, and 3 respectively. The context-dependent HMM for the phoneme DH(SIL, IH) 70 is then concatenated with the context-dependent HMMs that represent phonemes in the rest of the text.

In the next step of the iterative process, the speech waveform is mapped to the states of the HMM by segmenting or time aligning the frames to each state and their respective senone with the segmentation component 21 (step 52 in FIG. 2). In the example, state 1 of the HMM model for DH(SIL, IH) 70 and senone 20 (72) is aligned with frames 1–4, 78; state 2 of the same model and senone 1 (74) is aligned with frames 5–32, 80; and state 3 of the same model and senone 5, 76 is aligned with frames 33–40, 82. This alignment is performed for each state and senone in the HMM sequence 68. Once this segmentation is performed, the parameters of the HMM are reestimated (step 54). The well-known Baum-Welch or forward-backward algorithms can be used. The Baum-Welch algorithm is preferred since it is more adept at handling mixture density functions. A more detailed description of the Baum-Welch algorithm can be found in the Huang reference noted above. It is then determined whether convergence has been reached (step 56). If there has not yet been convergence, the process is reiterated by segmenting the set of utterances with the new HMM models (i.e., step 52 is repeated with the new HMM models). Once convergence is reached, the HMM parameters and the segmentation are in finalized form.

After convergence is reached, the frames corresponding to the instances of each diphone unit are stored as unit instances or instances for the respective diphone or other unit in unit storage 28 (step 58). This is illustrated in FIGS. 3A–3D. Referring to FIGS. 3A–3C, the phoneme string 66 is converted into a diphone string 67. A diphone represents the steady part of two adjacent phonemes and the transition between them. For example, in FIG. 3C, the diphone DH_IH 84 is formed from states 2–3 of phoneme DH(SIL, IH) 86 and from states 1–2 of phoneme IH(DH,S) 88. The frames associated with these states are stored as the instance corresponding to diphone DH_IH(0) 92. The frames 90 correspond to a speech waveform 91.

Referring to FIG. 2, steps 54–58 are repeated for each input speech utterance that is used in the analysis method. Upon completion of these steps, the instances accumulated from the training data for each diphone are pruned to a subset containing a robust representation covering the higher probability instances, as shown in step 60. FIG. 4 depicts the manner in which the set of instances is pruned.

Referring to FIG. 4, the method 60 iterates for each diphone (step 100). The mean and variance of the duration over all the instances is computed (step 102). Each instance can be composed of one or more frames, where each frame can represent a parametric representation of the speech signal over a certain time interval. The duration of each instance is the accumulation of these time intervals. In step 104, those instances which deviate from the mean by a specified amount (e.g., a standard deviation) are discarded. Preferably, between 10–20% of the total number of instances for a diphone are discarded. The mean and variance for pitch and amplitude are also calculated. The instances that vary from the mean by more than a predetermined amount (e.g., ±a standard deviation) are discarded.

Steps 108–110 are performed for each remaining instance, as shown in step 106. For each instance, the associated probability that the instance was produced by the HMM can be computed (step 108). This probability can be computed by the well-known forward-backward algorithm which is described in detail in the Huang reference above. This computation utilizes the output and transition probabilities associated with each state or senone of the HMM representing a particular diphone. In step 110, the associated string of senones 69 is formed for the particular diphone (see FIG. 3A). Next in step 112, diphones with sequences of senones which have identical beginning and ending senones are grouped. For each group, the senone sequence having the highest probability is then chosen as part of the subset, 114. At the completion of steps 100–114, there is a subset of instances corresponding to a particular diphone (see FIG. 3C). This process is repeated for each diphone resulting in a table containing multiple instances for each diphone.

An alternative embodiment of the present invention seeks to keep instances that match well with adjacent units. Such an embodiment seeks to minimize distortion by employing a dynamic programming algorithm.

Once the analysis method is completed, the synthesis method of the preferred embodiment operates. FIGS. 5–7 illustrate the steps that are performed in the speech synthesis method 120 of the preferred embodiment. The input text is processed into a word string (step 122) in order to convert input text into a corresponding phoneme string (step 124). Thus, abbreviated words and acronyms are expanded to complete word phrases. Part of this expansion can include analyzing the context in which the abbreviated words and acronyms are used in order to determine the corresponding word. For example, the acronym "WA" can be translated to "Washington" and the abbreviation "Dr." can be translated into either "Doctor" or "Drive" depending on the context in which it is used. Character and numerical strings can be replaced by textual equivalents. For example, "Feb. 1, 1995" can be replaced by "February first nineteen hundred and ninety five." Similarly, "$120.15" can be replaced by one hundred and twenty dollars and fifteen cents. Syntactic analysis can be performed in order to determine the syntactic structure of the sentence so that it can be spoken with the proper intonation. Letters in homographs are converted into sounds that contain primary and secondary stress marks. For example, the word "read" can be pronounced differently depending on the particular tense of the word. To account for this, the word is converted to sounds which represent the associated pronunciation and with the associated stress marks.

Once the word string is constructed (step 122), the word string is converted into a string of phonemes (step 124). In order to perform this conversion, the letter-to-sound component 33 utilizes the dictionary 22 and the letter-to-phoneme rules 40 to convert the letters in the words of the word string into phonemes that correspond with the words. The stream of phonemes is transmitted to prosody engine 35, along with tags from the natural language processor. The tags are identifiers of categories of words. The tag of a word may affect its prosody and thus, is used by the prosody engine 35.

In step 126, prosody engine 35 determines the placement of pauses and the prosody of each phoneme on a sentential basis. The placement of pauses is important in achieving natural prosody. This can be determined by utilizing punctuation marks contained within a sentence and by using the syntactic analysis performed by natural language processor 32 in step 122 above. Prosody for each phoneme is determined on a sentence basis. However, this invention is not limited to performing prosody on a sentential basis. Prosody can be performed using other linguistic bases, such as but not limited to words or multiple sentences. The prosody parameters can consist of the duration, pitch or intonation, and amplitude of each phoneme. The duration of a phoneme is affected by the stress that is placed on a word when it is spoken. The pitch of a phoneme can be affected by the intonation of the sentence. For example, declarative and interrogative sentences produce different intonation patterns. The prosody parameters can be determined with the use of prosody models which are stored in prosody database 42. There are numerous well-known methods for determining prosody in the art of speech synthesis. One such method is found in J. Pierrehumbert, *The Phonology and Phonetics of English Intonation,* MIT Ph.D. dissertation (1980) which is hereby incorporated by reference. The phoneme string with pause markers and the prosodic parameters indicating pitch, duration, and amplitude is transmitted to speech synthesizer 36.

In step 128, speech synthesizer 36 converts the phoneme string into a diphone string. This is done by pairing each phoneme with its right adjacent phoneme. FIG. 3A illustrates the conversion of the phoneme string 66 to the diphone string 67.

For each diphone in the diphone string, the best unit instance for the diphone is selected in step 130. In the preferred embodiment, the selection of the best unit is determined based on the minimum spectral distortion between the boundaries of adjacent diphones which can be concatenated to form a diphone string representing the linguistic expression. FIGS. 6A–6C illustrate unit selection for the linguistic expression, "This is great." FIG. 6A illustrates the various unit instances which can be used to form a speech waveform representing the linguistic expression "This is great." For example, there are 10 instances, 134, for the diphone DH_IH; 100 instances, 136, for the diphone IH_S; and so on. Unit selection proceeds in a fashion similar to the well-known Viterbi search algorithm which can be found in the Huang reference noted above. Briefly, all possible sequences of instances which can be concatenated to form a speech waveform representing the linguistic expression are formed. This is illustrated in FIG. 6B. Next, the spectral distortion across adjacent boundaries of instances is determined for each sequence. This distortion is computed as the distance between the last frame of an instance and the first frame of the adjacent right instance. It should be noted that an additional component can be added to the calculation of spectral distortion. In particular, the Euclidean distance of pitch and amplitude across two instances may be calculated as part of the spectral distortion calculation. This component compensates for acoustic distortion that is attributable to excessive modulation of pitch and amplitude. Referring to FIG. 6C, the distortion for the instance string 140, is the difference between frames 142 and 144, 146 and 148, 150 and 152, 154 and 156, 158 and 160, 162 and 164, and 166 and 168. The sequence having minimal distortion is used as the basis for generating the speech.

FIG. 7 illustrates the steps used in determining the unit selection. Referring to FIG. 7, steps 172–182 are iterated for each diphone string (step 170). In step 172, all possible sequences of instances are formed (see FIG. 6B). Steps 176–178 are iterated for each instance sequence (step 174). For each instance, except the last, the distortion between the instance and the instance immediately following it (i.e., to the right of it in the sequence) are computed as the Euclidean distance between the coefficients in the last frame of the instance and the coefficients in the first frame of the following instance. This distance is represented by the following mathematical definition:

$$d(\bar{x}, \bar{y}) = \sum_{i=1}^{N} (x_i - y_i)^2$$

$\bar{x}=(x_1, \ldots, x_n)$: frame $\bar{x}$ having n coefficients;

$\bar{y}=(y_1, \ldots, y_n)$: frame $\bar{y}$ having n coefficients;

N=number of coefficients per frame.

In step 180, the sum of the distortions over all of the instances in the instance sequence is computed. At the completion of iteration 174, the best instance sequence is selected in step 182. The best instance sequence is the sequence having the minimum accumulated distortion.

Referring to FIG. 5, once the best unit selection has been selected, the instances are concatenated in accordance with the prosodic parameters for the input text, and a synthesized speech waveform is generated from the frames corresponding to the concatenated instances (step 132). This concatenation process will alter the frames corresponding to the selected instances in order to conform to the desired prosody. Several well-known unit concatenation techniques can be used.

The above detailed invention improves the naturalness of synthesized speech by providing multiple instances of an acoustical unit, such as a diphone. Multiple instances provides the speech synthesis system with a comprehensive variety of waveforms from which to generate the synthesized waveform. This variety minimizes the spectral discontinuities present at the boundaries of adjacent instances since it increases the likelihood that the synthesis system will concatenate instances having minimal spectral distortion across the boundaries. This eliminates the need to alter an instance to match the spectral frequency of adjacent boundaries. A speech waveform constructed from unaltered instances produces a more natural sounding speech since it encompasses waveforms in their natural form.

Although the preferred embodiment of the invention has been described hereinabove in detail, it is desired to emphasize that this is for the purpose of illustrating the invention and thereby to enable those skilled in this art to adapt the invention to various different applications requiring modifications to the apparatus and method described hereinabove; thus, the specific details of the disclosures herein are not intended to be necessary limitations on the scope of the present invention other than as required by the prior art pertinent to this invention.

We claim:

1. A computer readable medium having stored thereon a speech synthesizer, comprising:

a speech unit store generated according to the steps of:

obtaining an estimate of hidden Markov models (HMMs) for a plurality of speech units;

receiving training data as a plurality of speech waveforms;

segmenting the speech waveforms by performing the steps of:

obtaining text associated with the speech waveforms; and converting the text into a speech unit string formed of a plurality of training speech units;

re-estimating the HMMs based on the training speech units, each HMM having a plurality of states, each state having a corresponding senone; and repeating the steps of segmenting and re-estimating until a probability of the parameters of the HMMs generating the plurality of speech waveforms reaches a threshold level; and mapping each waveform to one or more states and corresponding senones of the HMMs to form a plurality of instances corresponding to each training speech unit and storing the plurality of instances in the speech unit store; and a speech synthesizer component configured to synthesize an input linguistic expression by performing the steps of:

converting the input linguistic expression into a sequence of input speech units;

generating a plurality of sequences of instances corresponding to the sequence of input speech units based on the plurality of instances in the speech unit store; and generating speech based on one of the sequences of instances having a lowest dissimilarity between adjacent instances in the sequence of instances.

2. The computer readable medium of claim 1 wherein the speech waveforms are formed as a plurality of frames, each frame corresponding to a parametric representation of a portion of the speech waveforms over a predetermined time interval, and wherein mapping comprises:

temporally aligning each frame with a corresponding state in the HMMs to obtain a senone associated with the frame.

3. The computer readable medium of claim 2 wherein mapping further comprises:

mapping each of the training speech units to a sequence of the frames and an associated sequence of senones to obtain a corresponding instance of the training speech unit; and repeating the step of mapping each of the training speech units to obtain the plurality of instances for each of the training speech units.

4. The computer readable medium of claim 3 wherein the speech unit store is generated by performing steps further comprising:

grouping sequences of senones having common first and last senones to form a plurality of grouped senone sequences;

calculating a probability for each of the grouped senone sequences indicative of a likelihood that the senone sequence produced the corresponding instance of the training speech unit.

5. The computer readable medium of claim 4 wherein the speech unit store is generated by performing steps further comprising:

pruning the senone sequences based on the probability calculated for each grouped senone sequence.

6. The computer readable medium of claim 5 wherein pruning comprises:

discarding all senone sequences in each of the grouped senone sequences having a probability less than a desired threshold.

7. The computer readable medium of claim 6 wherein discarding comprises:

discarding all senone sequences in each of the grouped senone sequences except a senone sequence having a highest probability.

8. The computer readable medium of claim 7 wherein the speech unit store is generated by performing steps further comprising:

discarding instances of the training speech units having a duration which varies from a representative duration by an undesirable amount.

9. The computer readable medium of claim 7 wherein the speech unit store is generated by performing steps further comprising:

discarding instances of the training speech units having a pitch or amplitude which varies from a representative pitch or amplitude by an undesirable amount.

10. The computer readable medium of claim 1 wherein the speech synthesizer is configured to perform the steps of:

for each of the sequences of instances, determining dissimilarity between adjacent instances in the sequence of instances.

11. A method of performing speech synthesis, comprising:

obtaining an estimate of hidden Markov models (HMMs) for a plurality of speech units;

receiving training data as a plurality of speech waveforms;

segmenting the speech waveforms by performing the steps of:

obtaining text associated with the speech waveforms; and converting the text into a speech unit string formed of a plurality of training speech units;

re-estimating the HMMs based on the training speech units, each HMM having a plurality of states, each state having a corresponding senone;

repeating the steps of segmenting and re-estimating until a probability of the parameters of the HMMs generating the plurality of speech waveforms reaches a threshold level;

mapping each waveform to one or more states and corresponding senones of the HMMs to form a plurality of speech unit instances corresponding to each training speech unit, and storing the plurality of speech unit instances;

receiving an input linguistic expression;

converting the input linguistic expression into a sequence of input speech units;

generating a plurality of sequences of instances corresponding to the sequence of input speech units based on the plurality of speech unit instances stored; and generating speech based on one of the sequences of instances having a lowest dissimilarity between adjacent instances in the sequence of instances.

12. The method claim 11 wherein the speech waveforms are formed as a plurality of frames, each frame corresponding to a parametric representation of a portion of the speech waveforms over a predetermined time interval, and wherein mapping comprises:

temporally aligning each frame with a corresponding state in the HMMs to obtain a senone associated with the frame.

13. The method of claim 12 wherein mapping further comprises:

mapping each of the training speech units to a sequence of the frames and an associated sequence of senones to obtain a corresponding instance of the training speech unit; and repeating the step of mapping each of the training speech units to obtain the plurality of instances for each of the training speech units.

14. The method of claim 13 further comprising the steps of:

grouping sequences of senones having common first and last senones to form a plurality of grouped senone sequences; and calculating a probability for each of the grouped senone sequences indicative of a likelihood that the senone sequence produced the corresponding instance of the training speech unit.

15. The method of claim 14 further comprising the steps of:

pruning the senone sequences based on the probability calculated for each grouped senone sequence.

16. The method of claim 15 wherein pruning comprises:

discarding all senone sequences in each of the grouped senone sequences having a probability less than a desired threshold.

17. The method of claim 16 wherein discarding comprises:

discarding all senone sequences in each of the grouped senone sequences except a senone sequence having a highest probability.

18. The method of claim 17 further comprising the step of:

discarding instances of the training speech units having a duration which varies from a representative duration by an undesirable amount.

19. The method of claim 17 further comprising the step of:

discarding instances of the training speech units having a pitch or amplitude which varies from a representative pitch or amplitude by an undesirable amount.

* * * * *